US011045838B2

(12) United States Patent
Galk et al.

(10) Patent No.: US 11,045,838 B2
(45) Date of Patent: Jun. 29, 2021

(54) SEPARATOR, SEPARATOR MILL AND METHOD FOR SEPARATING A GAS-SOLIDS MIXTURE

(71) Applicant: NEUMAN & ESSER PROCESS TECHNOLOGY GMBH, Übach-Palenberg (DE)

(72) Inventors: Joachim Galk, Gangelt-Birgden (DE); Thomas Mingers, Übach-Palenberg (DE); Marc Giersemehl, Krefeld (DE)

(73) Assignee: NEUMAN & ESSER PROCESS TECHNOLOGY GMBH, Übach-Palenberg (DE)

( * ) Notice: Subject to any disclaimer, the term of this patent is extended or adjusted under 35 U.S.C. 154(b) by 155 days.

(21) Appl. No.: 16/349,369

(22) PCT Filed: Nov. 2, 2017

(86) PCT No.: PCT/EP2017/078061

§ 371 (c)(1),
(2) Date: May 13, 2019

(87) PCT Pub. No.: WO2018/091277

PCT Pub. Date: May 24, 2018

(65) Prior Publication Data

US 2019/0366385 A1 Dec. 5, 2019

(30) Foreign Application Priority Data

Nov. 15, 2016 (DE) ..... 10 2016 121 925.8

(51) Int. Cl.

| | |
|---|---|
| ***B07B 11/04*** | (2006.01) |
| ***B07B 7/083*** | (2006.01) |
| *B02C 15/00* | (2006.01) |

(52) U.S. Cl.
CPC ..... *B07B 7/083* (2013.01); *B07B 11/04* (2013.01); *B02C 2015/002* (2013.01)

(58) Field of Classification Search
CPC ..... B07B 7/083; B07B 11/04; B07B 4/08; B07B 4/04; B07B 9/00; B07B 9/02; B04C 5/06
See application file for complete search history.

(56) References Cited

U.S. PATENT DOCUMENTS 2,758,713 A * 8/1956 Hardinge ..... B07B 7/083 209/714
4,626,343 A * 12/1986 Folsberg ..... B07B 11/04 209/138

(Continued)

FOREIGN PATENT DOCUMENTS

DE 3808023 A1 9/1989
DE 9313930 U1 11/1993

(Continued)

*Primary Examiner* — Patrick H Mackey
(74) *Attorney, Agent, or Firm* — Hudak, Shunk & Farine Co. LPA

(57) ABSTRACT

A separator having a separator housing, a separator wheel arranged inside the separator housing and having an axis of rotation (X), and a guide vane assembly arranged in the separator housing, an annular space being provided between the guide vane assembly and the separator housing radially (R) perpendicular to the axis of rotation (X). In order to increase separation performance, a peripheral annular gap is provided in the vertical direction between the guide vane assembly and a cover.

19 Claims, 15 Drawing Sheets

(56) References Cited

U.S. PATENT DOCUMENTS

| | | | | |
|---|---|---|---|---|
| 4,689,141 | A * | 8/1987 | Folsberg | B07B 11/04 209/714 |
| 5,622,321 | A | 4/1997 | Brundiek et al. | |
| 5,624,039 | A * | 4/1997 | Folsberg | B07B 11/04 209/714 |
| 6,644,479 | B1 * | 11/2003 | Kimmeyer | B07B 7/083 209/143 |
| 6,827,221 | B1 | 12/2004 | Brundiek et al. | |
| 8,813,967 | B2 | 8/2014 | Plant et al. | |
| 10,137,478 | B2 | 11/2018 | Hagemeier et al. | |
| 2010/0236458 | A1 | 9/2010 | Otani et al. | |

FOREIGN PATENT DOCUMENTS

| | | | |
|---|---|---|---|
| DE | 4423815 | C2 | 9/1996 |
| DE | 29623150 | U1 | 11/1997 |
| DE | 102016121927 | B3 | 1/2018 |
| EP | 0171987 | A2 | 2/1986 |
| EP | 0204412 | A2 | 12/1986 |
| EP | 1153661 | A1 | 11/2001 |
| EP | 1239966 | B1 | 1/2005 |
| EP | 2659988 | B1 | 10/2015 |
| GB | 2412888 | A | 12/2005 |
| WO | 2014124899 | A1 | 8/2014 |

* cited by examiner

SEPARATOR, SEPARATOR MILL AND METHOD FOR SEPARATING A GAS-SOLIDS MIXTURE

FIELD OF THE INVENTION

The present invention relates to a separator, a mill having a separator and a method for separating a gas-solids mixture.

BACKGROUND OF THE INVENTION

By separation is meant in general the sorting of solids according to certain criteria such as mass density or particle size. Winnowing is a group of separation processes in which a gas stream, the so-called separating air, is used to accomplish this sorting. The active principle is based on that fact that fine or small particles are influenced more strongly and carried along by the gas stream than are large or coarse particles.

Wind separators are used for example for the classifying of coal dust and other grist of a mill. The goal here is to separate particles which have been ground sufficiently small after the grinding process from particles needing further grinding. These two particle groups are also called fines and tailings. Basically, a separator may also be used for the sorting or classifying of solids of different origin.

There are various kinds of wind separators. A major distinguishing criterion is the manner in which the solid substance being separated, or the feedstock, and the separating air are introduced into the separator. Thus, solids and separating air may either be introduced separately from each other or jointly.

A wind separator, in which solids and separating air are introduced jointly, is known from US 2010/0236458 A1. The disclosed wind separator is used for sorting of coal dust. The mixture of coal dust and separating air is admitted to the separator housing from underneath. The inlet volume flow of the gas-solids mixture flows entirely from the outside into the interior of a guide vane assembly. The guide vane assembly has a multitude of deflecting elements, between which the mixture flows. The deflecting elements are tilted relative to the horizontal by 50 to 70° and secured. Inside the guide vane assembly is situated a separator wheel. The separator wheel is driven in rotation and has a multitude of fins, running substantially vertically. Fine particles by virtue of the flow and despite the rotation of the separator wheel can get in between the fins of the separator wheel and are afterwards sucked out at the top. Coarse particles, on the other hand, strike against the fins and are bounced back in this way and finally drop down because of gravity.

In other wind separators the guide vanes of the guide vane assembly are arranged vertically, such as in WO 2014/124899 A1. The guide vanes proposed there may be straight or curved. Similar wind separators are also known from the publications EP 1 239 966 B1, EP 2 659 988 A1, DE 44 23 815 C2 and EP 1 153 661 A1. In the case of EP 2 659 988 A1, the fins are adjustable. In EP 1 153 661 A1, both vertical and horizontal fins are used, which on the whole should result in a more uniform flow.

One drawback of traditional wind separators in which the feedstock and the separating air are introduced jointly is a deficient sorting of coarse and fine material, also known as separating accuracy. Wind separators with other working principles, in which for example the direction of flow of the separating air is transverse to the direction of falling of the feedstock, bring about a swirling of the feedstock, so that a better separation of coarse and fine material results. In the above-described wind separators the mixture of feedstock and separating air flows entirely through the guide vane assembly and for the most part homogeneously through the separator. Therefore, increased wrong sorting results, in which especially particles of fine material end up in the coarse material.

WO 2014/124899 A1 seeks to solve this problem with fittings. The fittings may be arranged in the area between the guide vane assembly and the separator wheel, which is also called the separating zone. The purpose of the fittings is to counteract a homogeneous flow and thus to swirl the feedstock. However, due to the additional resistance, fittings result in less efficiency of the separator, which is manifested in particular as a higher power demand or a lower throughput rate of the separator.

EP 0 204 412 A2 discloses a separator with a separator housing and a separator wheel arranged therein. Guide vane assemblies with guide vanes are arranged radially outward from the separator wheel. The material flow occurs entirely through the guide vanes toward the separator wheel, where the separation is completed.

GB 2 412 888 A discloses a mill with an integrated separator. The separator has a separator wheel with a multitude of blades as well as a radially outward situated guide vane assembly. Beneath the guide vane assembly is situated a distributing plate, having a vertical spacing from the guide vane assembly.

From DE 296 23 150 U1 there is known a wind separator with a separator housing and a rotating separating wheel located therein. Radially outside the separator wheel there is arranged a guide vane assembly with guide vanes. Here as well, the flow of material occurs from the outside through the guide vanes in the direction of the separating wheel, where it is separated.

DE 93 13 930 U1 discloses a mill with an integrated separator. The separator comprises a separating wheel, which is surrounded radially on the outside by a guide vane assembly. Beneath the separator is arranged a grinding disc with grinding elements. A vertical gap exists between the guide vane assembly and the grinding disc.

DE 38 08 023 A1 also discloses a separator with a rotating separating wheel and a radially outward situated guide vane assembly, in which the material flow of the material stream being separated passes from the radial outside through the guide vane assembly and in this way reaches the rotating separating wheel.

From EP 0 171 987 A2 there appears a separator having a separator housing and a separating wheel situated therein. However, the separator disclosed there has no guide vanes. Only horizontally extending blades are provided, which rotate together with the separating wheel.

SUMMARY OF THE INVENTION

The problem which the invention proposes to solve is to improve the sorting precision of separators in which the feedstock and the separating air are introduced jointly. This problem is solved by a separator having a separator housing, a separator wheel arranged inside the separator housing and having an axis of rotation (X), and a guide vane assembly arranged in the separator housing, an annular space being provided between the guide vane assembly and the separator housing radially (R) perpendicular to the axis of rotation (X), wherein a peripheral annular gap is provided in a vertical direction between the guide vane assembly and a cover, by a mill, especially a pendulum mill, having the separator integrated therein, and by a separation method for separating a gas-solids mixture with the following steps: introducing an inlet volume flow (Q) from a gas-solids mixture into a separator with a separator wheel, a guide vane assembly and a separating zone arranged between the separator wheel and the guide vane assembly; apportioning the inlet volume flow (Q) into a first partial volume flow (Q1) and a second partial volume flow (Q2); introducing the first partial volume flow (Q1) into the separating zone bypassing the guide vane assembly; introducing the second partial volume flow (Q2) into the separating zone through the guide vane assembly.

Advantageous modifications are the subject matter of the dependent claims.

The separator according to the invention has a separator housing, in which are arranged a separator wheel and a guide vane assembly. The separator wheel has an axis of rotation X. An annular space is provided between the guide vane assembly and the separator housing radially perpendicular to the axis of rotation and a separating zone is provided between the guide vane assembly and the separator wheel.

The separator is characterized in that a peripheral annular gap is provided in the vertical direction between the guide vane assembly and a cover.

The axis of rotation X preferably extends in the vertical direction.

Separators of this kind are generally arranged upright. Therefore, in the following, directions parallel to the direction of the force of gravity shall be called "vertical". Accordingly, directions perpendicular to the direction of the force of gravity shall be called "horizontal".

The annular gap joins the annular space to the separating zone.

The annular gap has the benefit that the inlet volume flow can be apportioned. A first partial volume flow gets through the annular gap from above into the separating zone, a second partial volume flow flows through the guide vane assembly into the separating zone. The two partial volume flows meet in the separating zone, which results in a swirling and thus an improved separation. In this way, the separation accuracy of the process can be improved.

The annular gap preferably has a height HR.

In one advantageous modification, the guide vane assembly and/or the cover are movable in the direction of the axis of rotation X, so that the height HR of the annular gap is adjustable. In this way, the amount of the first partial volume flow can be adjusted. Thus, the ratio between the first and second partial flow can also be varied.

Preferably, the height HR is between 50 mm and 1000 mm, especially preferably between 200 mm and 1000 mm.

The cover may be a housing cover or a separator cover or an installed part in the cover area of the separator.

The housing cover is part of the separator housing and it closes off the separator housing at the top end. The housing cover is stationary during the operation of the separator. The housing cover may be vaulted on top, which favors the deflecting of the first partial volume flow into the separating zone.

Preferably, the separator cover is connected to the separator wheel, so that it rotates with the separator wheel. Advantageously, the separator cover is merely an annular disc. The separator cover is preferably arranged flush with a top edge of the separator wheel. An annular gap between the guide vane assembly and the separator cover has positive effect on the homogeneity of the flow in the annular space. In this way, a back flow in the annular space can be prevented or reduced.

Advantageously, the annular space tapers toward the top. By the flowing of the gas-solids mixture through the guide vane assembly, the volume flow decreases toward the top, so that it is advantageous to have the cross section of the annular spaces steadily decreasing toward the top, in order to enable a uniform flow through the guide vane assembly. This is accomplished by the tapering.

The annular space has a width B. The width B may be constant or vary in the vertical direction. In the design of the separator, the ratio between width B and height HR may be influenced. Preferably, the ratio B:HR is between 0.2 and 5, especially preferably between 0.5 and 2. If the width B is not constant, the mean value of the width B is used to calculate the ratio.

The guide vane assembly has a height HL. Advantageously, the ratio HL:HR is between 0.5 and 10, especially between 2 and 5. In this way, sufficient feedstock gets through both the guide vane assembly and the annular gap into the separating zone.

The guide vane assembly preferably has vertical guide vanes which are uniformly distributed about the periphery of the guide vane assembly. It has been discovered that the amounts of the second partial volume flow can be adjusted more easily and accurately if the guide vane assembly is outfitted with additional deflecting elements.

Preferably, at least one deflecting element is arranged between at least two neighboring vertical guide vanes, having at least one downwardly directed curvature and/or bending. Thanks to the downwardly directed curvature and/or bending, a controlled diverting of the gas-solids mixture into the separating zone of the separator is possible. By a bending is meant an angled straight section of the deflecting element.

Preferably, at least one deflecting element is arranged between at least two neighboring vertical guide vanes.

A further benefit of these deflecting elements is that the flow of the gas-solids mixture can additionally be imparted a horizontal and/or vertical downward directed movement component already inside the guide vane assembly. This results inside the separating zone in a better presentation of the flow to the separator wheel, which in turn heightens the separating accuracy of the separator.

If a multitude of deflecting elements are provided in a separator, the deflecting elements may either be identical or different. Preferably, all deflecting elements inside a separator are identical, so that the production costs can be lowered. However, it may be advantageous to use deflecting elements of different configuration in a separator, in order to produce different effects at different places inside the separator.

Features which are described in the following with respect to one deflecting element may also be used in other deflecting elements in the very same embodiment of a separator according to the invention and preferably in all deflecting elements of this embodiment.

Advantageously, at least one of the deflecting elements extends over the entire width between two neighboring guide vanes. In this way, regions inside the guide vane assembly where an uncontrolled flow into the separating zone might occur are avoided.

In advantageous modifications it is provided that at least one of the deflecting elements extends from the guide vane assembly into the separating zone and/or into the annular space.

In particular, an extension into the annular space is advantageous, since in this case the gas-solids mixture already strikes against the deflecting elements in the annular space and is deflected.

In this way, it becomes possible to very effectively branch off a portion of the gas-solids mixture for the second partial volume flow. The quantity of the second partial volume flow can be adjusted even more specifically by the length of the deflecting elements protruding into the annular space. Thus, there are two adjustment possibilities for the ratio of the partial volume flows, namely, by adjusting the annular gap width on the one hand and by the arrangement and configuration of the deflecting elements on the other hand. Depending on the design situation, e.g., also the installation in a mill, it is thereby possible to use one or the other or even both of the adjustment possibilities In order to enable a uniform deflecting, one of the deflecting elements has a variable radius of curvature in a partial section in the radial direction R of the guide vane assembly. Preferably, at least one of the deflecting elements has a variable radius of curvature over the entire length in the radial direction R.

Advantageously, at least one of the deflecting elements has a radial inner end with a first end section and/or a radial outer end with a second end section. The terms radial inner and radial outer refer here to the guide vane assembly. The guide vane assembly preferably has a cylindrical basic form. The end sections may be configured in different ways, as shall be explained more closely in the following.

One end section comprises preferably less than 40%, especially less than 20% of the overall length of a deflecting element.

In advantageous modifications of the separator, at least one of the end sections is straight. A section is straight if it has no curvature. This configuration is advantageous especially for the first end section of the radial inner end. At the radial inner end, the gas-solids mixture should flow as homogeneously as possible in the direction of the separator wheel. The straight configuration of the first end section favors a homogeneous flow.

Straight end sections are preferably bent, i.e., angled, and thus form bends.

Preferably, at least one of the end sections is arranged horizontally. Especially preferably, this is the first end section of the radial inner end. This also serves for generating a homogeneous flow in the direction of the separator wheel.

In advantageous modifications it is provided that at least one of the second end sections or its tangential prolongation runs at an angle $\alpha$ to a horizontal H, whereby $\alpha \geq 20°$. The second end sections are arranged each time at an outer end of the deflecting elements. The gas-solids mixture when used as intended arrives from below at the deflecting elements. Therefore, it is especially advantageous for the second end sections to be directed downward at an angle $\alpha$ greater than or equal to 20°. Especially preferably, moreover, $\alpha \leq 60°$.

A tangential prolongation means a straight prolongation of an arc-shaped section which is tangential to the curvature at an end point of the section. The arc-shaped section is preferably viewed in cross section for the determination of the tangential prolongation.

The extent of the deflection of the gas-solids mixture has an influence on the separating accuracy. If the deflection is too great, swirling or back flow may be formed. Too little a deflection will have no effect.

In advantageous modifications of the invention it is therefore provided that the first end section of at least one of the deflecting elements or its tangential prolongation and the second end section of the same deflecting elements or its tangential prolongation run together at an angle $\beta$, where $\beta \geq 90°$. In particular, $\beta \geq 120°$. Especially preferably, moreover, $\beta \leq 160°$.

Depending on which solid is being sorted and what the particle distribution is in the gas-solids mixture, it may be advantageous to arrange the first end section at an angle greater than 0° to the horizontal H. In advantageous modifications, it is provided that at least one of the first end sections or its tangential prolongation runs at an angle $\gamma$ to the horizontal H, while: $\gamma \geq 10°$. In order to prevent increased coarse material from ending up in the fine material, the gas-solids mixture can be deflected downward in this way by the deflecting element and thus in the direction in which the coarse material will ultimately end up. However, the angle $\gamma$ should not be chosen too large. Preferably, $\gamma \leq 45$, especially $\gamma \leq 30$.

Regarding the angles $\alpha$, $\beta$ and $\gamma$ it is especially preferable for: $a+\beta+\gamma=180°$. Preferably, the angles are situated beneath the same horizontal H.

It has been found that already with one deflecting element between every two neighboring vertical guide vanes it is possible to achieve good results in terms of the flow relations.

In advantageous modifications of the separator it is provided that there are arranged at least three to five deflecting elements between every two neighboring vertical guide vanes. In this way, the gas-solids mixture flowing between two neighboring vertical guide vanes is divided into partial streams, so that swirling is avoided and the streams become homogenized.

In advantageous modifications, the guide vane assembly has at least one swirl breaker. Swirl breakers prevent a flow in the circumferential direction of the guide vane assembly and in this way homogenize the flow of the gas-solids mixture.

The problem is also solved with a mill which is combined with a separator according to the invention. The mill is preferably a pendulum mill or a roller mill. Preferably, the separator is integrated in the mill.

The method according to the invention for separating a gas-solids mixture has the following steps:

- introducing an inlet volume flow Q from a gas-solids mixture into a separator with a separator wheel, a guide vane assembly and a separating zone arranged between the separator wheel and the guide vane assembly;
- apportioning the inlet volume flow Q into a first partial volume flow Q1 and a second partial volume flow Q2;
- introducing the first partial volume flow Q1 into the separating zone bypassing the guide vane assembly;
- introducing the second partial volume flow Q2 into the separating zone through the guide vane assembly.

Advantageously, the inlet volume flow is divided by providing an annular gap between the guide vane assembly and a cover.

Preferably, the first partial volume flow Q1 is introduced into the separating zone from above. In this way, the material of the first partial volume flow Q1 can flow down through the entire separating zone from above. In this way, there is a greater likelihood of the material becoming sorted, i.e., properly separated into coarse and fine material. This improves the separating accuracy.

Advantageously, the first partial volume flow Q1 or the second partial volume flow Q2 is introduced into the separating zone substantially in the direction of the force of gravity.

The inlet volume flow when the device is used properly flows at first from the inlet to the annular space between the separator housing and the guide vane assembly. In traditional separators, the gas-solids mixture then flows entirely through the guide vane assembly. Due to the annular gap, the first partial volume flow Q1 flows past the guide vane assembly and into the separating zone from above. The second partial volume flow Q2 of the gas-solids mixture flows through the guide vane assembly into the separating zone.

Basically, the first partial volume flow Q1 also moves downward by the force of gravity through the separating zone.

A further benefit of the apportioning into two partial streams Q1, Q2 is that the partial streams Q1, Q2 mutually sort each other in the separating zone. This self-sorting consists of a swirling of the gas-solids mixture in the separating zone. In this way, fine material and coarse material are better separated from each other.

The ratio between the first partial volume flow Q1 and the second partial volume flow Q2 can be adjusted. In advantageous modifications, it is proposed that the ratio Q1:Q2 between the first partial volume flow and the second partial volume flow is between 20:80 and 80:20, especially between 40:60 and 60:40.

For a good self-separation, it is advantageous for the two partial volume flows Q1, Q2 to be guided such that they meet each other in the separating zone at an angle φ, where: $45° < \varphi < 135°$, especially $70° < \varphi < 110°$. The flow angle φ may advantageously be adjusted by means of the deflecting elements.

BRIEF DESCRIPTION OF THE DRAWINGS

The invention shall be represented and explained with the aid of the figures as an example. There are shown.

DETAILED DESCRIPTION OF THE INVENTION

Figure 1:
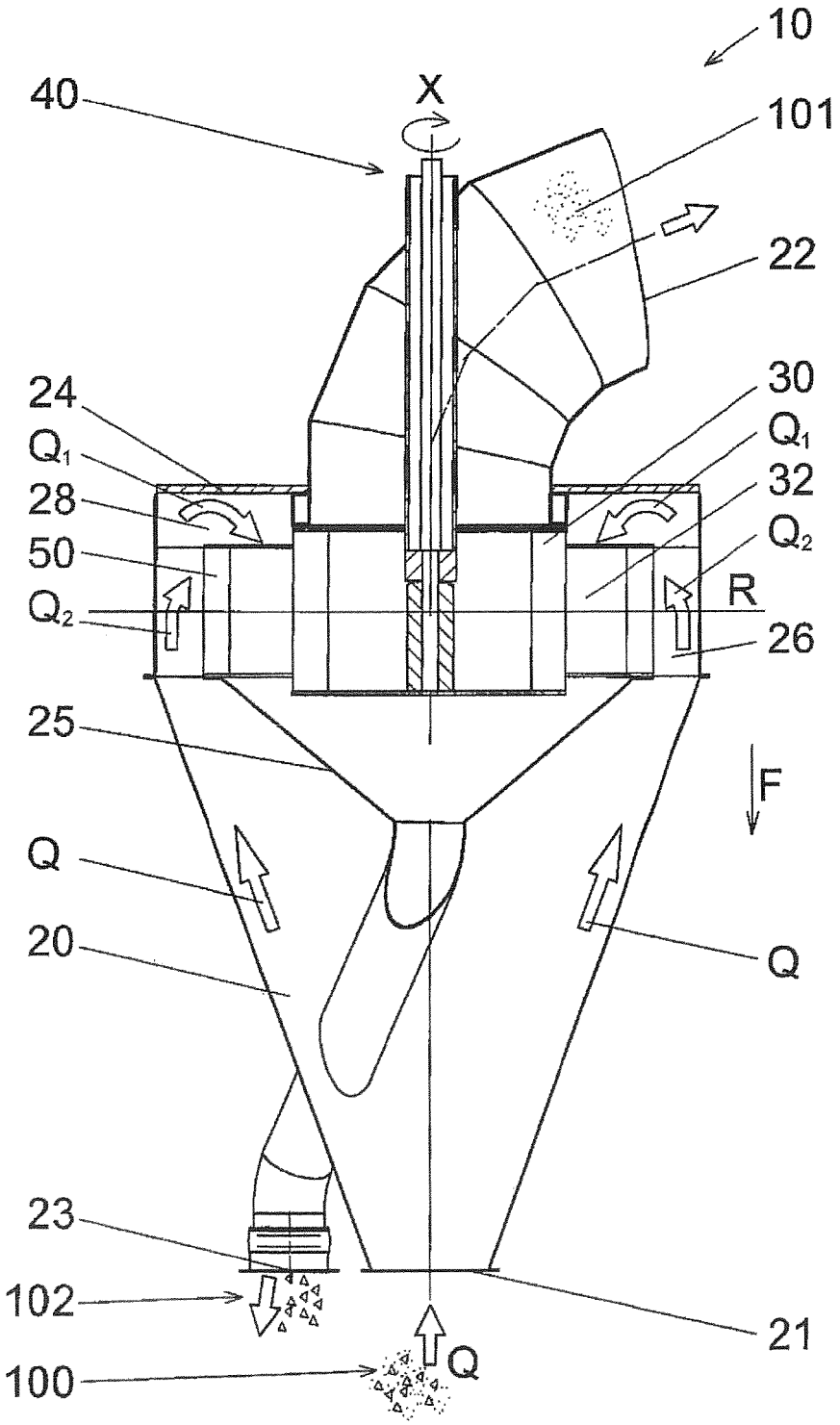
FIG. 1 a schematic side view of a separator in cross section.

FIG. 1 shows a separator 10. The separator 10 comprises a separator housing 20. In a lower region, the separator housing 20 has an inlet 21 for a volume flow Q of a gas-solids mixture 100.

In the separator housing 20 there are arranged a separator wheel 30 and a guide vane assembly 50. The separator wheel 30 and the guide vane assembly 50 have a common principal axis, which is the axis of rotation X for the separator wheel 30. The axis of rotation X extends in the direction of the force of gravity F. Perpendicular to the axis of rotation X extends a radial direction R. Between the guide vane assembly 50 and the separator housing 20, an annular space 26 is provided in the radial direction R. The space between the separator wheel 30 and the guide vane assembly 50 forms the separating zone 32.

The separator wheel 30 is driven in rotation by a drive device 40, so that the separator wheel 30 turns about the axis of rotation X.

Between the guide vane assembly 50 and a housing cover 24 there is situated an annular gap 28. The volume flow Q entering the annular space 26 from below is apportioned into two partial volume flows Q1 and Q2, whereby the partial volume flow Q1 passes through the annular gap 28 and gets into the separating zone 32 from above. The partial volume flow Q2 flows through the guide vane assembly 50 and in this way gets into the separating zone 32. Thus, the two partial volume flows Q1 and Q2 meet once more in the separating zone 32.

Above the separator wheel 30 there is arranged a first outlet 22. The first outlet 22 is connected to a suction mechanism (not shown), which creates a negative pressure. A first particle variety 101, the fine material, is sucked through the first outlet 22 when the device is used as intended.

Beneath the separator wheel 30 there is arranged a funnel 25. The funnel 25 empties into a second outlet 23. A second particle variety 102, the coarse material, is taken away through the second outlet 23 when the device is used as intended. The separator wheel 30 rejects large particles 102. These large particles get into the funnel 25 and from there go to the second outlet 23.

The separator housing 20 is closed at the top end by a housing cover 24.

Figure 2:
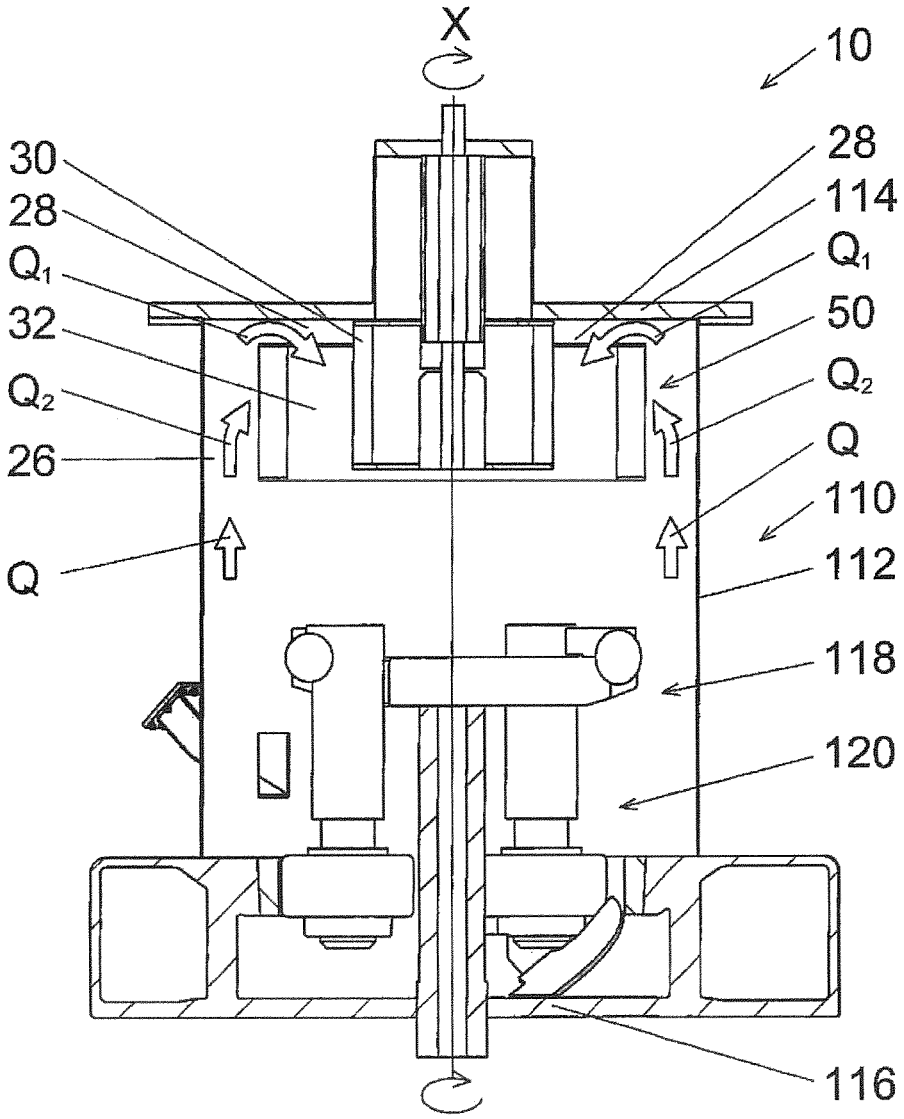
FIG. 2 a mill with integrated separator per FIG. 1 in cross section.

FIG. 2 shows a mill 110, which is designed as a pendulum mill. Inside the housing 112, which is closed off on top by a mill cover 114 and at the bottom by means of a mill floor 116, there is located a milling mechanism 118, comprising several milling pendulums 120. Through the milling mechanism 118, the separator 10 is integrated into the mill housing. Between the mill housing 112 and the guide vane assembly 50 there is situated the annular space 26. The annular gap 28 is located between the guide vane assembly 50 and the mill cover 114.

Figure 3:
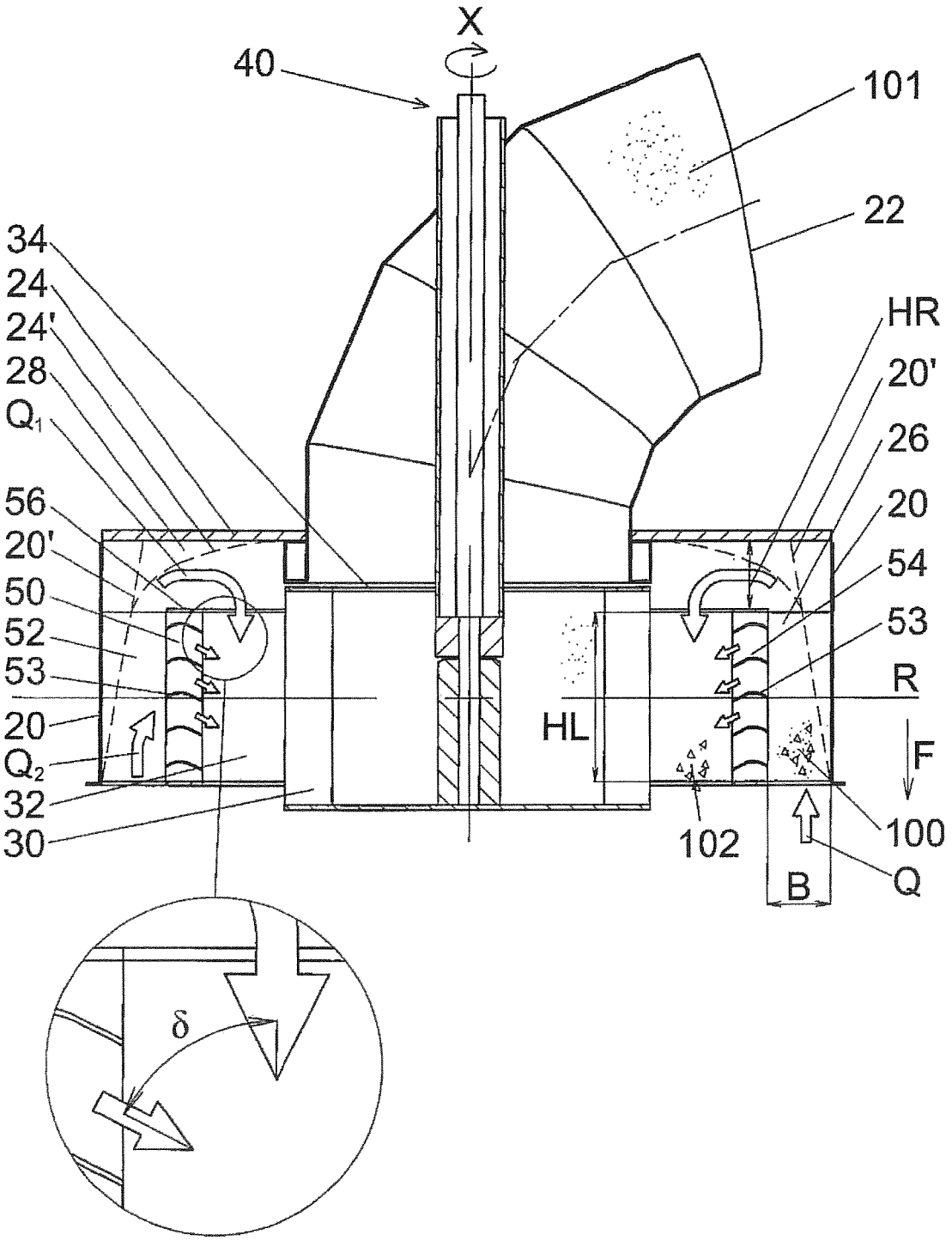
FIG. 3 a schematic side view of the upper section of the separators of FIG. 1 partly in cross section.

FIG. 3 shows the top part of the separator 10. The separator wheel 30 is situated inside the guide vane assembly 50. Between the separator wheel 30 and the guide vane assembly 50 there is situated a separating zone 32. The cylindrical separator housing 20 can also be conical in design. With such a conical separator housing 20' (shown by broken line), an upwardly tapering annular space 26 is formed.

Likewise shown in broken lines is a modification of the housing cover. The housing cover 24' is vaulted at the top, which favors the deflecting of the partial volume flow Q1.

The encircling annular gap 28 is present between the guide vane assembly 50 and the housing cover 24 in the vertical direction. The annular gap 28 has a height HR. The annular space 26 has a width B. In the embodiment shown, the ratio B:HR is around 1.

The guide vane assembly 50 has a height HL. In the embodiment shown, the ratio HL:HR is around 3.5.

The first outlet 22 communicates with the interior space of the separator wheel 30.

The guide vane assembly 50 has a multitude of vertical guide vanes 54. Five deflecting elements 53 are arranged between neighboring vertical guide vanes 54, each of them having a downwardly pointing curvature.

A top edge 34 of the separator wheel 30 is located above the top edge 56 of the guide vane assembly 50. More than 50% of the annular gap 28 in the vertical direction is located entirely above the top edge 34 of the separator wheel 30.

The volume flow Q of the gas-solids mixture 100 flows from the bottom into the annular space 26. A first partial volume flow Q1 can flow through the annular gap 28. The first partial volume flow Q1 gets into the separating zone 32 from above in this way. A second partial volume flow Q2 flows through the guide vane assembly 50 into the separating zone 32 and impinges on the first partial volume flow Q1 there. The deflecting elements 53 impart flow components directed at the separator wheel to the gas-solids mixture flowing through the guide vane assembly 50, as indicated by the arrows drawn. The partial volume flows Q1, Q2 meet at an angle φ (see the enlarged partial representation in FIG. 3). The angle φ in the embodiment shown is around 45°.

For reasons of clarity, Q2 indicates only one possible flow path for a partial stream of the second partial volume flow Q2. However, the second partial volume flow Q2 in its entirety designates the total volume flow moving from the annular space 26 through the guide vane assembly 50 into the separating zone 32.

Fine particles 101 move from the separating zone 32 into the interior of the separator wheel 30 and are sucked through the first outlet 22.

Figure 4:
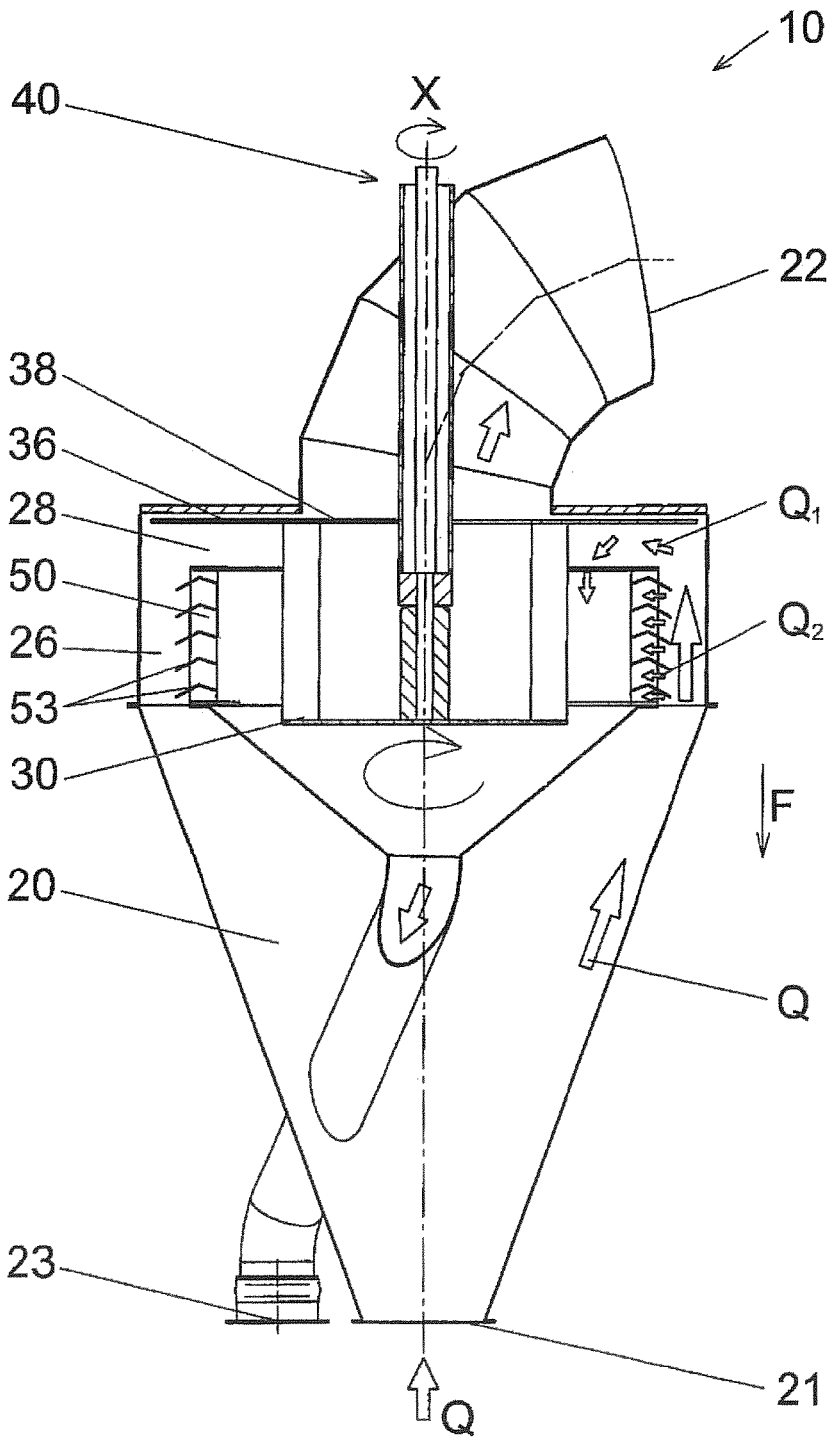
FIG. 4 a schematic side view of a separator according to a further embodiment in cross section.

FIG. 4 shows another embodiment of a separator 10. The separator 10 comprises a separator housing 20 with an inlet 21, a first outlet 22 and a second outlet 23. In the separator housing 20 there are arranged a separator wheel 30 and a guide vane assembly 50. The separator wheel is driven in rotation.

The separator wheel 30 comprises a separator cover 36. The separator cover 36 has the form of an annular disc. In the middle of the separator cover 36 is situated an opening 38. Through the opening 38, material can flow from the interior of the separator wheel 30 to the first outlet 22.

The separator cover 36 rotates with the separator wheel 30. An encircling annular gap 28 is provided between the separator cover 36 and the guide vane assembly 50 in the vertical direction.

The guide vane assembly 50 is outfitted with a further configuration of the deflecting elements 53, having a bend. Furthermore, the deflecting elements 53 extend into the annular space 26.

Figure 5:
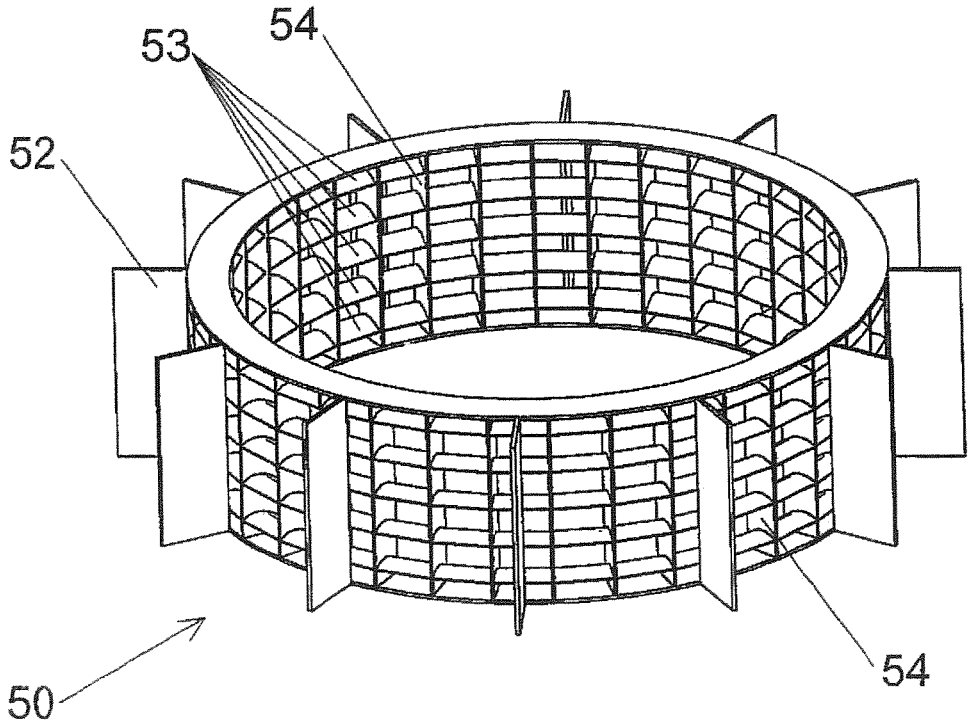
FIG. 5 a guide vane assembly in perspective representation.
Figure 6:
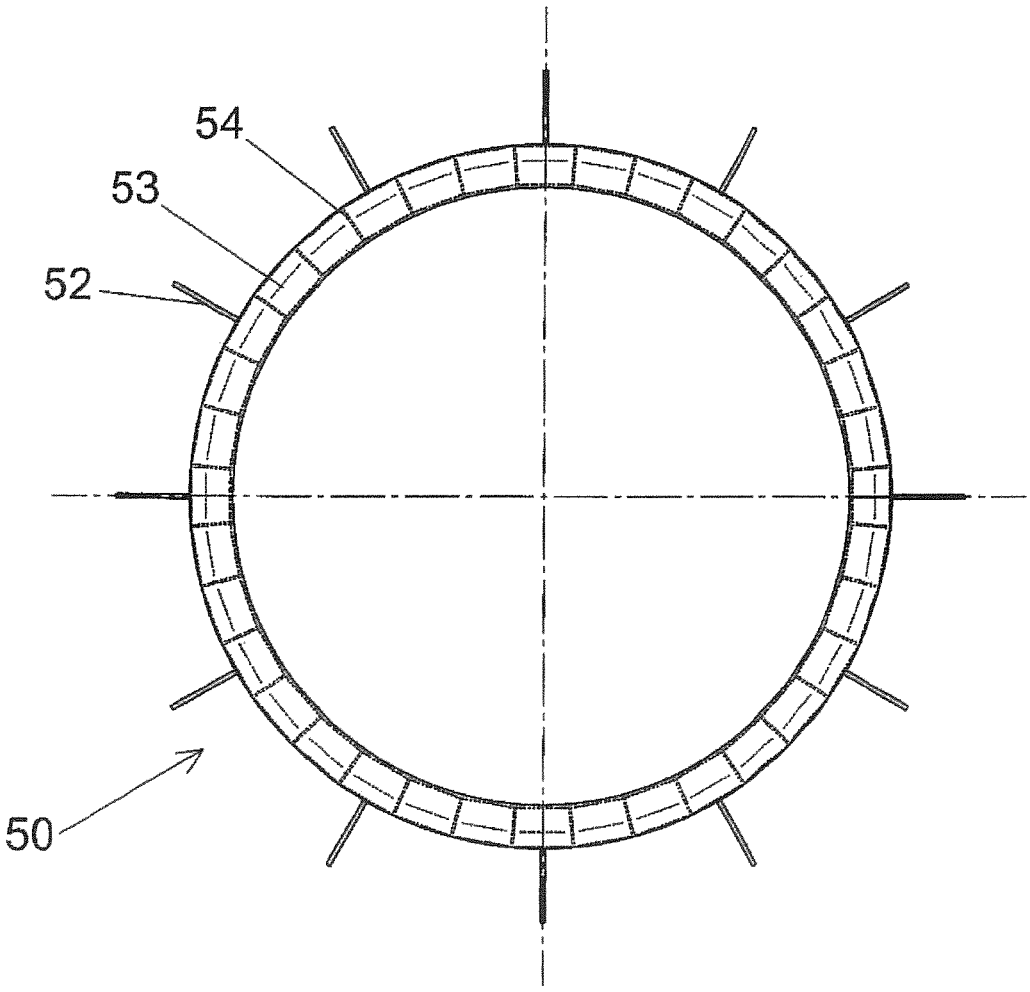
FIG. 6 the guide vane assembly of FIG. 5 in a top view.

FIG. 5 shows the guide vane assembly 50 of FIG. 3 in a perspective representation. FIG. 6 shows a top view of the guide vane assembly 50 represented in FIG. 5.

The guide vane assembly 50 has a plurality of vertical guide vanes 54, with five deflecting elements 53 being arranged between every two neighboring guide vanes 54. Each deflecting element 53 extends across the entire width between two vertical guide vanes 54. The deflecting elements 53 are arranged equidistant in the vertical direction.

On its outer circumferential surface the guide vane assembly 50 has a multitude of swirl breakers 52, unlike the guide vane assembly 50 of FIG. 3. The swirl breakers 52 protrude into the annular space 26 and oppose a flow in the circumferential direction. The swirl breakers 52 have a rectangular basic form and are made of sheet metal. The swirl breakers 52 stand off in the radial direction R from the guide vane assembly 50 and extend across the entire height of the guide vane assembly.

Figure 7:
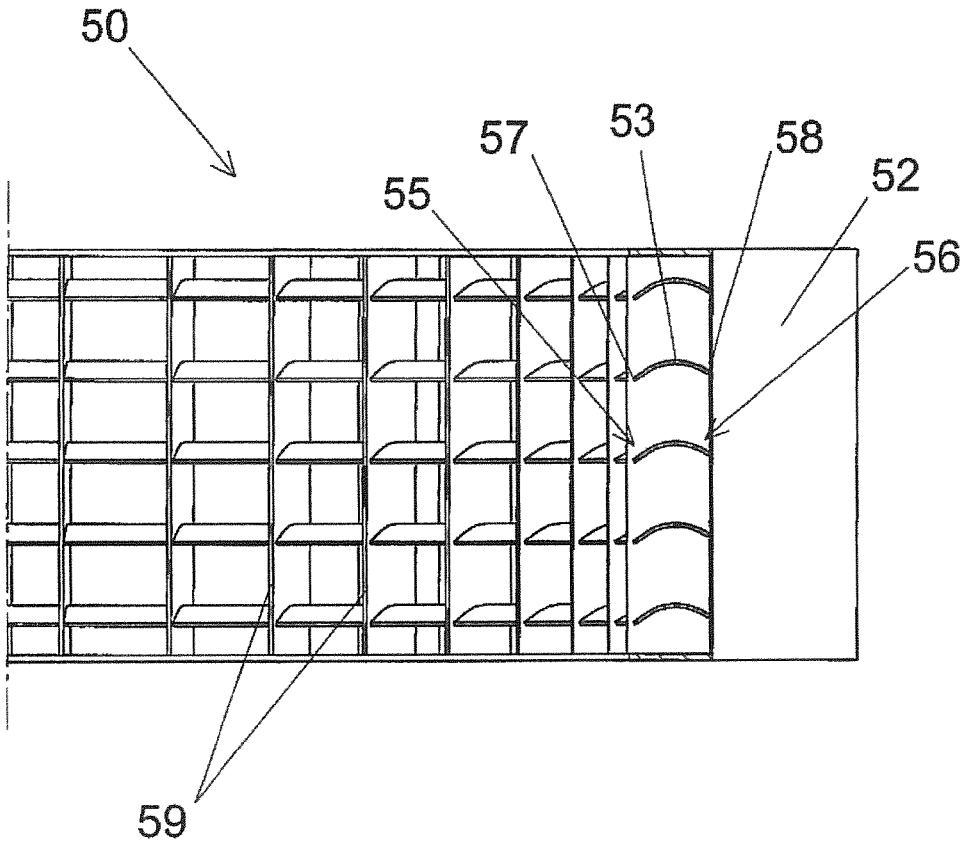
FIG. 7 an enlarged cut-out of the guide vane assembly shown in FIGS. 5 and 6.
Figure 8:
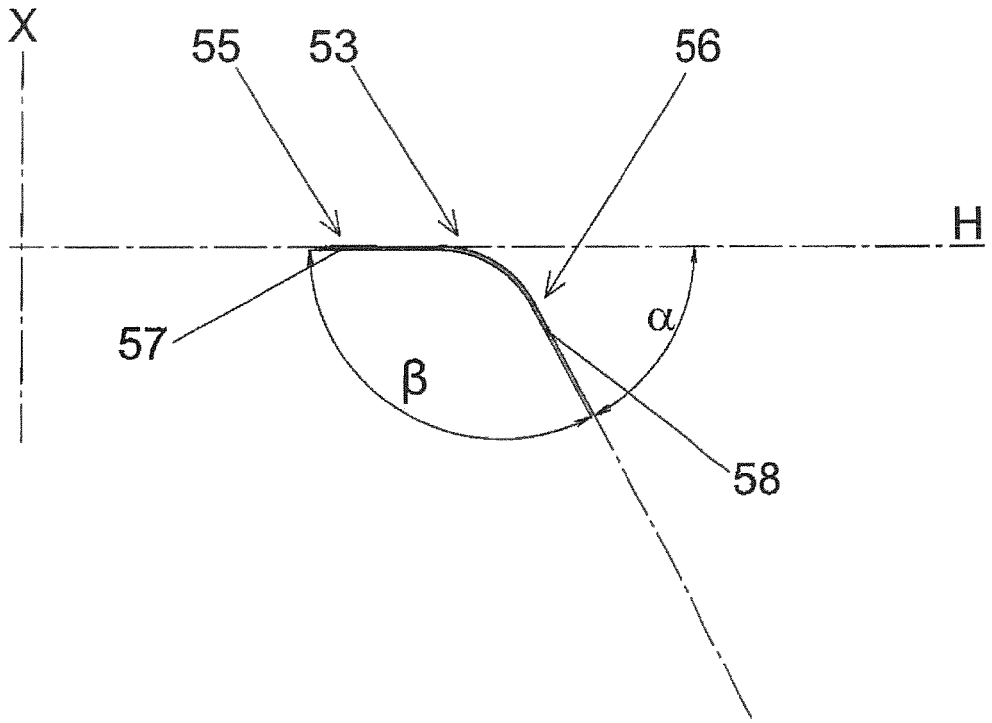
FIGS. 8-14 different embodiments of deflecting elements in side view.
Figure 9:
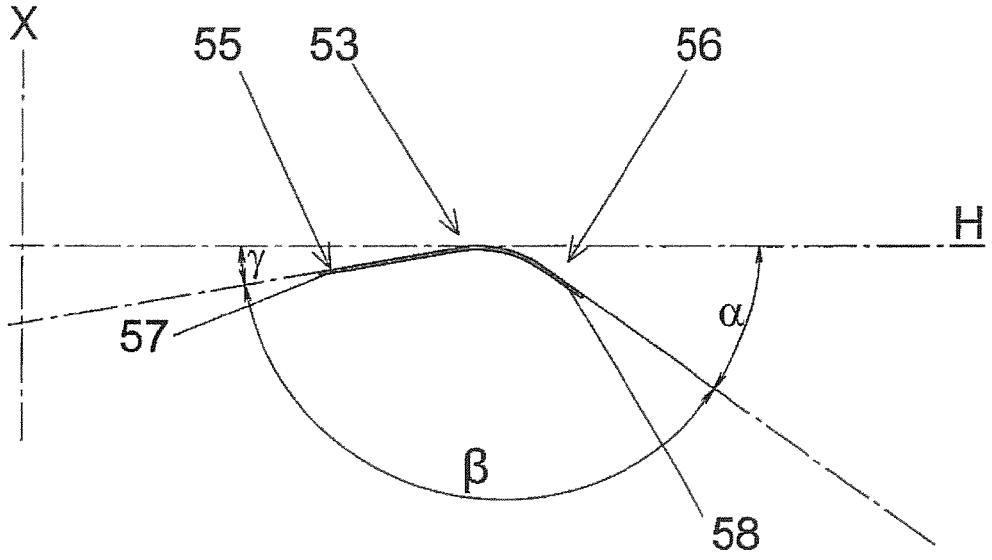
Figure 10:
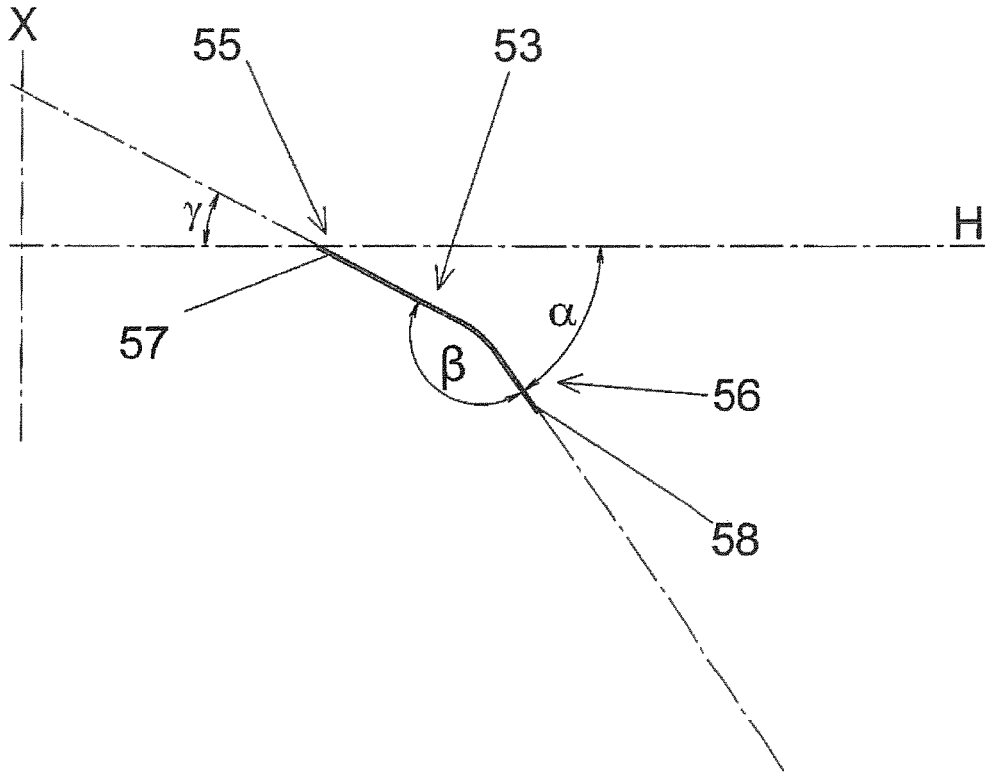
Figure 11:
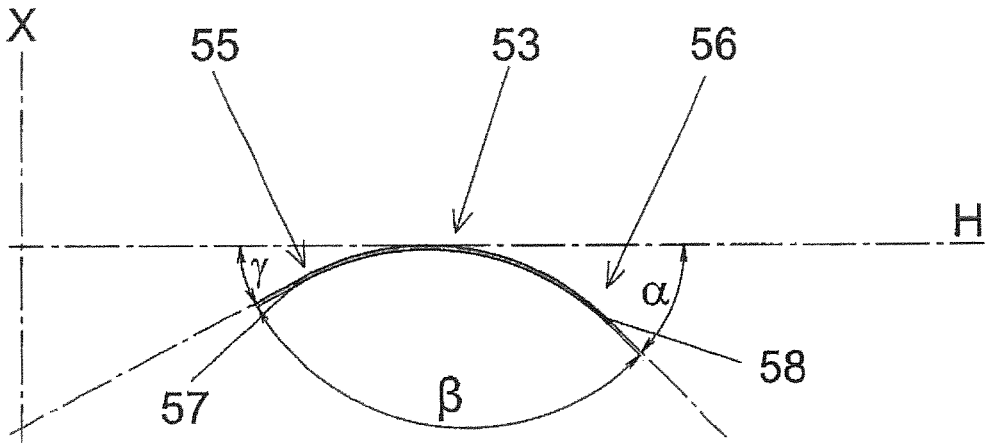
Figure 12:
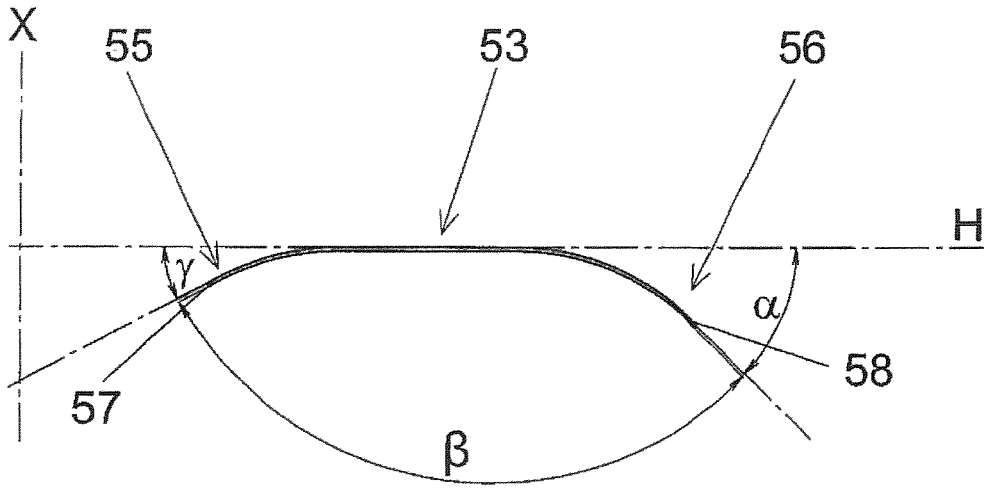

FIG. 7 shows an enlarged cut-out of the guide vane assembly 50 represented in FIG. 5.

The deflecting elements 53 have a downwardly pointing curvature. Each deflecting element 53 has a radial inner end 55 and a radial outer end 56. The radial inner ends 55 do not protrude into the separating zone 32 in the embodiment shown.

A first end section 57 is arranged at the radial inner end 55 of each deflecting element 53 and a second end section 58 is arranged at the radial outer end 56 of each deflecting element 53. The two end sections 57, 58 are curved.

FIGS. 8 to 14 show different embodiments of a deflecting element 53. The deflecting elements 53 each have a radial inner end 55 and a radial outer end 56. The radial inner end 55 has a first end section 57 and the radial outer end 56 has a second end section 58. The deflecting elements 53 have a downwardly directed curvature (see FIGS. 8 to 12) or a downwardly directed bend (see FIGS. 13 and 14).

The deflecting elements 53 are arranged relative to an axis of rotation X of the separator wheel (not shown here), the spacing between deflecting element 53 and axis of rotation X being shown smaller here for drawing reasons.

Figure 13:
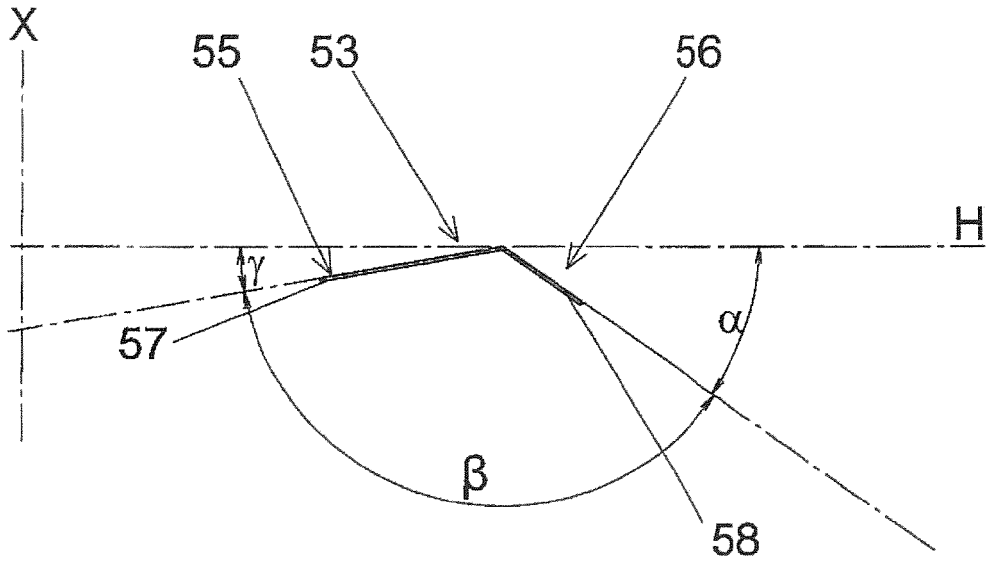
Figure 14:
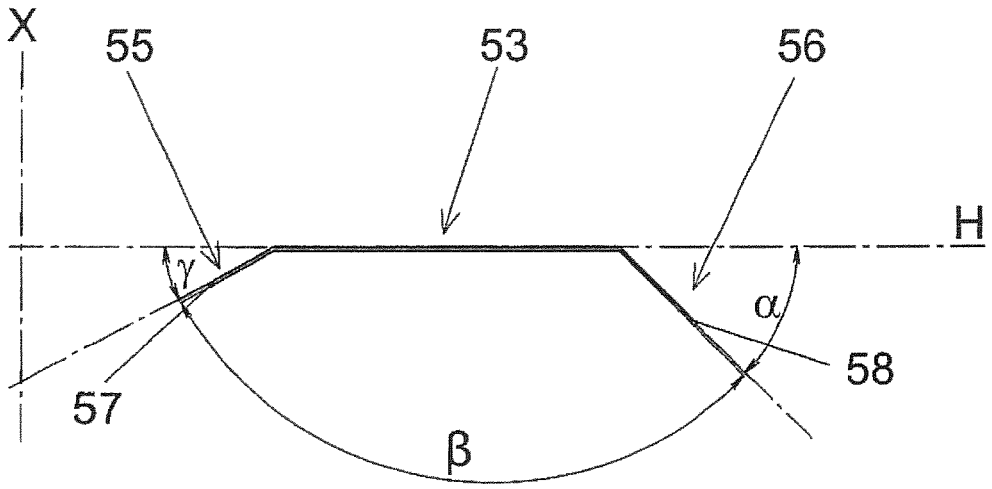

The embodiments shown in FIGS. 8 to 14 differ in particular in the configuration of the end sections 57, 58. The end sections 57, 58 may both be curved (see FIGS. 8 to 10) or both be straight (see FIGS. 12 and 14), while also straight and/or curved end sections may be joined together across a curved middle section. FIGS. 13 and 14 show deflecting elements 53 with bends.

The first end section 57 of each deflecting element 53 or its tangential prolongation (see FIG. 11) is situated at an angle γ to the horizontal H. The angle γ in the embodiments shown is between 0° (see FIG. 8) and around 28° (see, e.g., FIG. 12). The horizontal H, which corresponds to the radial direction R, makes a right angle with the axis of rotation X.

The second end section 58 of each deflecting element 53 or its tangential prolongation (see FIGS. 8, 9, 11, 12) is situated at an angle α to the horizontal H. The angle α in the embodiments shown is between around 35° (see, e.g., FIG. 9) and around 65° (see FIG. 8).

The first end section 57 and the second end section 58 of a deflecting element 53 or its tangential prolongations make an angle β. The angle β in the embodiments shown is between around 108° (see FIG. 12) and around 153° (see FIG. 10).

The angles α, β and γ in the embodiments shown add up to 180°. With the exception of angle γ in FIG. 10, all angles α, β, γ point downward.

Figure 15:
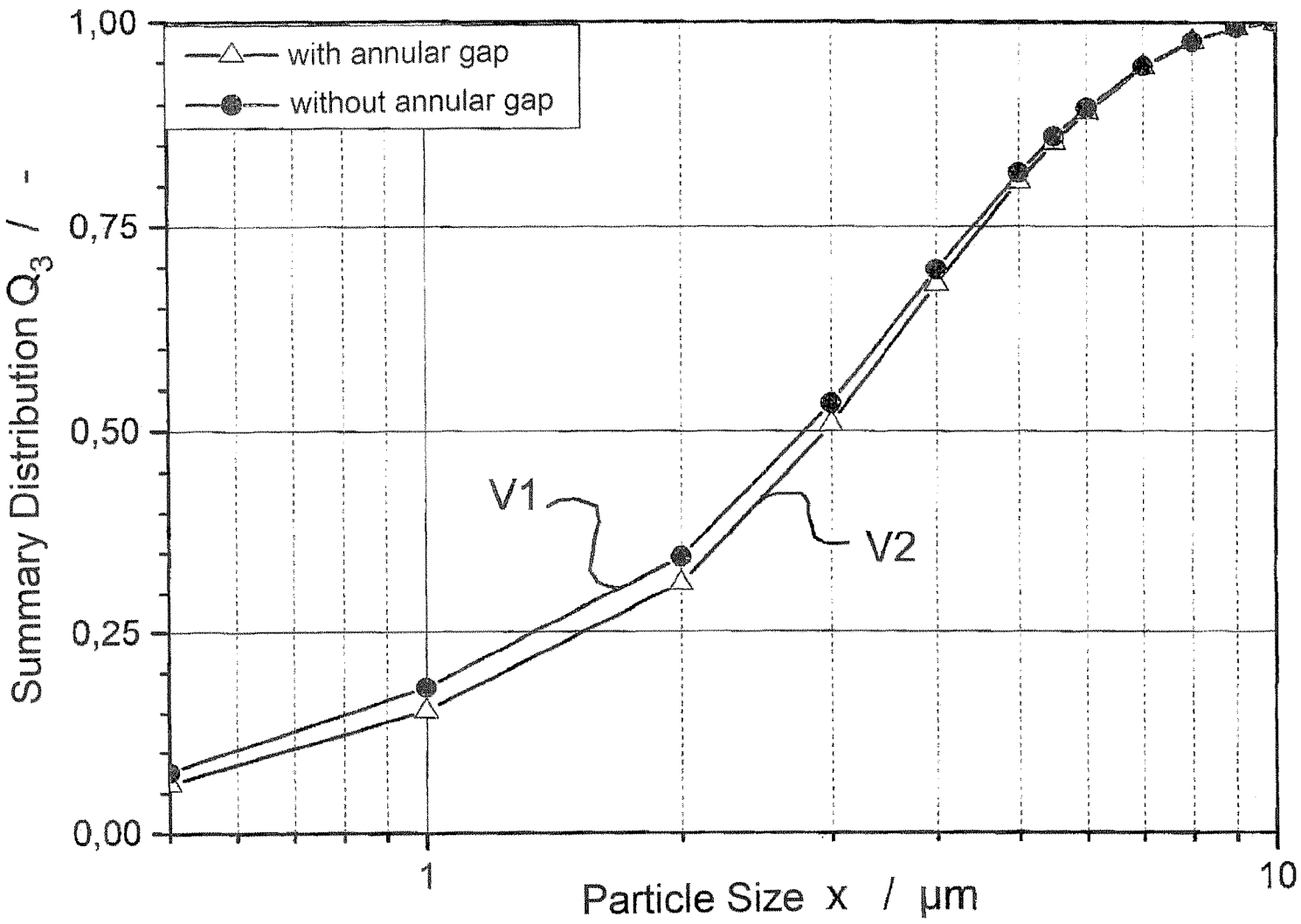
FIG. 15 a diagram with summary distributions plotted against particle sizes.

FIG. 15 shows a diagram of summary distributions plotted against particle sizes. The distributions of two separations are shown, a first distribution V1 and a second distribution V2. The first distribution V1 is designated by dots, the second distribution V2 by triangles. In the first distribution V1, a separator was used without an annular gap. The second distribution V2, on the other hand, shows the result of a separation making use of a separator with an annular gap.

Identical starting material was used in the two separations.

For identical starting material, it basically holds that a steeper curve should be evaluated more positively than a curve which is less steep. The desired result of a sorting process is generally the fine material. In the case of using the separator according to the invention in a separation mill, for example, the fine material is removed and the coarse material is returned to the mill, in order to be crushed further or crushed again. Particles actually belonging to the fine material, yet ending up in the coarse material, cost extra time and energy, since they need to run through the mill cycle once again. Particles actually belonging to the coarse material, yet ending up in the fine material, are much more disruptive, since they have direct negative impact on the quality of the end product (the fine material). Therefore, for the same starting material, a sorting with smaller fines fraction is positive. In the first distribution V1, the sum of the particles which are less than 2 μm is 0.344. Thanks to the use of an annular gap (second distribution V2), this fraction can be lowered by around 10% to 0.312. Especially in the region of larger particle sizes (>3 μm), the second distribution V2 is found to be more steep and therefore advantageous.

LIST OF REFERENCE SYMBOLS

10 Separator
20 Separator housing
20' Conical separator housing
21 Inlet
22 First outlet
23 Second outlet
24 Housing cover
24' Curved housing cover
25 Funnel
26 Annular space
28 Annular gap
30 Separator wheel
32 Separating zone
34 Top edge
36 Separator cover
38 Opening
40 Drive device
50 Guide vane assembly
52 Swirl breaker
53 Deflecting element
54 Guide vane
56 Top edge
100 Gas-solids mixture
101 First particle variety (fine)
102 Second particle variety (coarse)
B Width of annular space
F Force of gravity
H Horizontal
HL Height of guide vane assembly
HR Height of annular gap
Q Inlet volume flow
Q1 First partial volume flow
Q2 Second partial volume flow
R Radial direction
V1 First distribution
V2 Second distribution
X Axis of rotation
α Angle
β Angle
γ Angle
δ Angle

What is claimed is:

1. A separator, comprising:
a separator housing,
a separator wheel arranged inside the separator housing and having an axis of rotation (X), and
a guide vane assembly non-rotably arranged in the separator housing, an annular space being provided between the guide vane assembly and the separator housing radially (R) perpendicular to the axis of rotation (X),
wherein a peripheral annular gap is provided in a vertical direction between the guide vane assembly and a cover.

2. The separator as claimed in claim 1, wherein the annular gap has a height (HR), while the guide vane assembly and/or the cover are movable in the direction of the axis of rotation (X), so that the height (HR) is adjustable.

3. The separator as claimed in claim 2, wherein the height (HR) is between 50 mm and 1000 mm.

4. The separator as claimed in claim 1, wherein the cover is a housing cover or a separator cover.

5. The separator as claimed in claim 4, wherein the separator cover is connected to the separator wheel, so that the separator cover rotates with the separator wheel.

6. The separator as claimed in claim 1, wherein the annular space tapers toward the top.

7. The separator as claimed in claim 1, wherein the annular space has a width (B), and the ratio B:HR is between 0.2 and 5.

8. The separator as claimed in claim 1, wherein the guide vane assembly has a height (HL), and the ratio HL:HR is between 0.5 and 10.

9. The separator as claimed in claim 1, wherein the guide vane assembly has a plurality of vertical guide vanes, wherein at least one deflecting element is arranged between at least two guide vanes, having at least one downwardly directed curvature or bending.

10. The separator as claimed in claim 9, wherein the deflecting elements extend over an entire width between two neighboring guide vanes.

11. The separator as claimed in claim 9, wherein at least one of the deflecting elements extends from the guide vane assembly into a separating zone and/or into the annular space.

12. The separator as claimed in claim 9, wherein at least one of the deflecting elements has a variable radius of curvature in a partial section in the radial direction (R) of the guide vane assembly.

13. The separator as claimed in claim 1, wherein the guide vane assembly has at least one swirl breaker.

14. A mill having an integrated separator as claimed in claim 1.

15. A method for separating a gas-solids mixture, comprising the following steps:
introducing an inlet volume flow (Q) from a gas-solids mixture into a separator with a separator wheel, a guide vane assembly and a separating zone arranged between the separator wheel and the guide vane assembly;
apportioning the inlet volume flow (Q) into a first partial volume flow (Q1) and a second partial volume flow (Q2);
introducing the first partial volume flow (Q1) into the separating zone bypassing the guide vane assembly; and
introducing the second partial volume flow (Q2) into the separating zone through the guide vane assembly.

16. The method for separating a gas-solids mixture as claimed in claim 15, wherein the first partial volume flow (Q1) is introduced into the separating zone from above.

17. The method for separating a gas-solids mixture as claimed in claim 15, wherein the first partial volume flow (Q1) or the second partial volume flow (Q2) is introduced into the separating zone substantially in the direction of the force of gravity (F).

18. The method for separating a gas-solids mixture as claimed in claim 15, wherein the ratio Q1:Q2 between the first partial volume flow (Q1) and the second partial volume flow (Q2) is between 20:80 and 80:20.

19. The method for separating a gas-solids mixture as claimed in claim 15, wherein the two partial volume flows (Q1, Q2) are guided such that they meet each other in the separating zone at an angle (φ), where: $45° < \varphi < 135°$.

* * * * *